US008286729B2

(12) United States Patent
Reckmann et al.

(10) Patent No.: US 8,286,729 B2
(45) Date of Patent: Oct. 16, 2012

(54) REAL TIME MISALIGNMENT CORRECTION OF INCLINATION AND AZIMUTH MEASUREMENTS

(75) Inventors: Hanno Reckmann, Humble, TX (US); Frank Schuberth, Hannover (DE); Bernd Santelmann, Boehme (DE)

(73) Assignee: Baker Hughes Incorporated, Houston, TX (US)

( * ) Notice: Subject to any disclaimer, the term of this patent is extended or adjusted under 35 U.S.C. 154(b) by 601 days.

(21) Appl. No.: 12/370,221

(22) Filed: Feb. 12, 2009

(65) Prior Publication Data

US 2009/0205867 A1 Aug. 20, 2009

Related U.S. Application Data

(60) Provisional application No. 61/029,161, filed on Feb. 15, 2008.

(51) Int. Cl.
*E21B 25/16* (2006.01)

(52) U.S. Cl. ..... 175/45; 175/61; 175/62; 175/73; 175/40

(58) Field of Classification Search ..... 175/45, 175/40, 61, 62, 73; 33/125
See application file for complete search history.

(56) References Cited

U.S. PATENT DOCUMENTS 4,479,564 A * 10/1984 Tanguy ..... 181/105
4,607,435 A * 8/1986 Boisen ..... 33/700
4,739,841 A * 4/1988 Das ..... 175/61
5,269,383 A * 12/1993 Forrest ..... 175/26
5,317,111 A * 5/1994 Orban et al. ..... 181/105
6,419,033 B1 * 7/2002 Hahn et al. ..... 175/61
7,054,750 B2 * 5/2006 Rodney et al. ..... 702/9
2003/0209365 A1 * 11/2003 Downton ..... 175/50
2004/0216921 A1 * 11/2004 Krueger ..... 175/24
2005/0150689 A1 * 7/2005 Jogi et al. ..... 175/45
2010/0307742 A1 * 12/2010 Phillips et al. ..... 166/250.01
2011/0272196 A1 * 11/2011 Konschuh et al. ..... 175/76

OTHER PUBLICATIONS

Studer et al.; "Improved BHA Sag Correction and Uncertainty Evaluation Brings Value to Wellbore Placement," SPE 102088, 2006 SPE Annual Technical Conference and Exhibition, San Antonio, Texas, Sep. 24-27, 2006, pp. 1-11.

* cited by examiner

*Primary Examiner* — William P Neuder
*Assistant Examiner* — Ronald Runyan
(74) *Attorney, Agent, or Firm* — Cantor Colburn LLP

(57) ABSTRACT

A method for determining wellbore trajectory includes determining survey parameters in the wellbore; measuring force parameter(s) in the wellbore; and correcting the survey parameters using the measured force parameter(s). The downhole measured force parameters may include forces associated with an operation of a steering device such as an internal reaction force, and/or a bending moment. In variants, the method may include measuring a wellbore temperature; measuring a wellbore parameter in addition to the temperature; and correcting a survey parameter using the measured parameter and the measured temperature. These methods may include correcting survey parameters using measured wellbore diameters. Also, a processor in the wellbore may be programmed to perform the correction while in the wellbore and/or control a steering device using measurements provided by a sensor for measuring internal reaction forces.

22 Claims, 5 Drawing Sheets

REAL TIME MISALIGNMENT CORRECTION OF INCLINATION AND AZIMUTH MEASUREMENTS

CROSS-REFERENCE TO RELATED APPLICATIONS

This application takes priority from the U.S. Provisional Application Ser. No. 61/029,161, filed on Feb. 15, 2008.

BACKGROUND OF THE DISCLOSURE

1. Field of the Disclosure

This disclosure relates generally to oilfield downhole tools and more particularly to methods and devices for enhanced directional drilling of wellbores.

2. Description of the Related Art

To obtain hydrocarbons such as oil and gas, boreholes or wellbores are drilled by rotating a drill bit attached to the bottom of a BHA (also referred to herein as a "Bottom Hole Assembly" or ("BHA"). The BHA is attached to the bottom of a tubing, which is usually either a jointed rigid pipe or a relatively flexible spoolable tubing commonly referred to in the art as "coiled tubing." The string comprising the tubing and the BHA is usually referred to as the "drill string." When jointed pipe is utilized as the tubing, the drill bit is rotated by rotating the jointed pipe from the surface and/or by a mud motor contained in the BHA. In the case of a coiled tubing, the drill bit is rotated by the mud motor. During drilling, a drilling fluid (also referred to as the "mud") is supplied under pressure into the tubing. The drilling fluid passes through the BHA and then discharges at the drill bit bottom. The drilling fluid provides lubrication to the drill bit and carries to the surface rock pieces disintegrated by the drill bit in drilling the wellbore. The mud motor is rotated by the drilling fluid passing through the BHA. A drive shaft connected to the motor and the drill bit rotates the drill bit.

In addition to vertically aligned wells, a substantial proportion of the current drilling activity involves drilling of deviated and horizontal wellbores to more fully exploit hydrocarbon reservoirs. Irrespective of the well profile, however, it is essential to place the well bore trajectory as precisely as possible to optimally produce hydrocarbons. Conventionally, a trajectory of a drilled wellbore is defined by measuring inclination and azimuth at discrete survey stations while drilling. From these angular measurements and together with the length of the drill string, the trajectory can be reconstructed. Azimuth and inclination may be measured by survey sensors positioned along the drill string. The bending of the part of the string where the sensors are placed may "sag" and cause the borehole centerline to not necessarily point in the same direction as the centerline of the MWD tool with the sensors.

The present disclosure addresses the need for systems and devices that correct for errors caused by misalignment, sag or bending in survey measurements.

SUMMARY OF THE DISCLOSURE

In aspects, the present disclosure provides systems and methods for determining a trajectory of a wellbore drilled in an earthen formation. The method may be used in connection with a drill string having one or more sensors configured to measure parameters relating to the downhole environment, the wellbore being drilled, the drill string being used to drill the wellbore, and/or forces that are applied to the drill string. In one embodiment, the method includes determining one or more survey parameters at a location in the wellbore using suitable survey instruments; measuring one or more force parameters in the wellbore using one or more sensors provided on the drill string; and correcting the survey parameter using the measured force parameter. The downhole measured force parameter may be a force associated with an operation of a steering device, and/or a bending moment. The downhole measured parameter may also be a normal force associated with a wellbore engagement device such as a centralizer or stabilizer that engages a wellbore wall. Moreover, the method may include measuring a wellbore diameter and correcting the survey parameter using the measured wellbore diameter. The method may be utilized in real-time or near real-time. For instance, in certain applications, the force parameter may be measured at approximately the same time that the survey parameter is determined. Additionally, the method may be performed in situ in the wellbore. Thus, in certain embodiments, the method may include conveying into the wellbore a processor that is programmed to perform the correction while in the wellbore. Further, in certain applications, the method may include estimating at least one directional coordinate for a selected wellbore device along the drill string using the corrected at least one survey parameter.

In one illustrative application, a drill string may be conveyed into the wellbore and the method may be used to determine a bend attributable to one or more force parameters measured in the wellbore. In another illustrative application, the method may be used to steer a drill string by using one or more survey parameters that have been corrected. Illustrative survey parameters include azimuth and inclination.

In aspects, the method may be used to provide continuous corrected survey data during drilling. For example, the method may include determining survey parameters at a plurality of locations in the wellbore; measuring a force parameter in the wellbore at the plurality of locations; and correcting the survey parameter determined at each of the locations using the force parameter measured at each of the locations.

In aspects, the present disclosure also provides a method for determining a trajectory of a wellbore drilled in an earthen formation that includes determining at least one survey parameter at a location in the wellbore; measuring a temperature in the wellbore; measuring at least one parameter in the wellbore in addition to the temperature; and correcting the at least one survey parameter using the at least one measured parameter and the measured temperature.

In aspects, the present disclosure further provides a computer-readable medium for use with an apparatus for correcting survey data relating to a drilled wellbore. The apparatus may include a drill string configured to be conveyed into a wellbore in the earth formation, a steering device configured to steer the drill string, a survey tool for measuring at least one survey parameter, and a sensor for measuring at least one force parameter. The medium may include instructions that enable at least one processor to correct the measured at least one survey parameter using the measured at least one force parameter. In arrangements, the medium may also include (i) a ROM, (ii) an EPROM, (iii) an EEPROM, (iv) a flash memory, and (v) an optical disk.

In still other aspects, the present disclosure provides an apparatus for steering a drill string. The apparatus may include a steering device having at least one pad configured to apply a force to a wall of a wellbore and a force measurement sensor configured to measure a reaction force associated with the force applied by the at least one pad. An illustrative method for controlling a steering device for steering a drill string may include operating the steering device to apply a force to a wall of the wellbore; measuring a reaction force associated with the force applied by the steering device; and controlling the steering device in response to the measured reaction force.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to devices and methods for obtaining accurate survey values for wellbore and for more accurate directional drilling of wellbores. In part, such accuracy is obtained by correcting survey measurements for physical distortion in a drill string at which one or more directional survey instruments are positioned. The present disclosure is susceptible to embodiments of different forms. The drawings show and the written specification describes specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Figure 1:
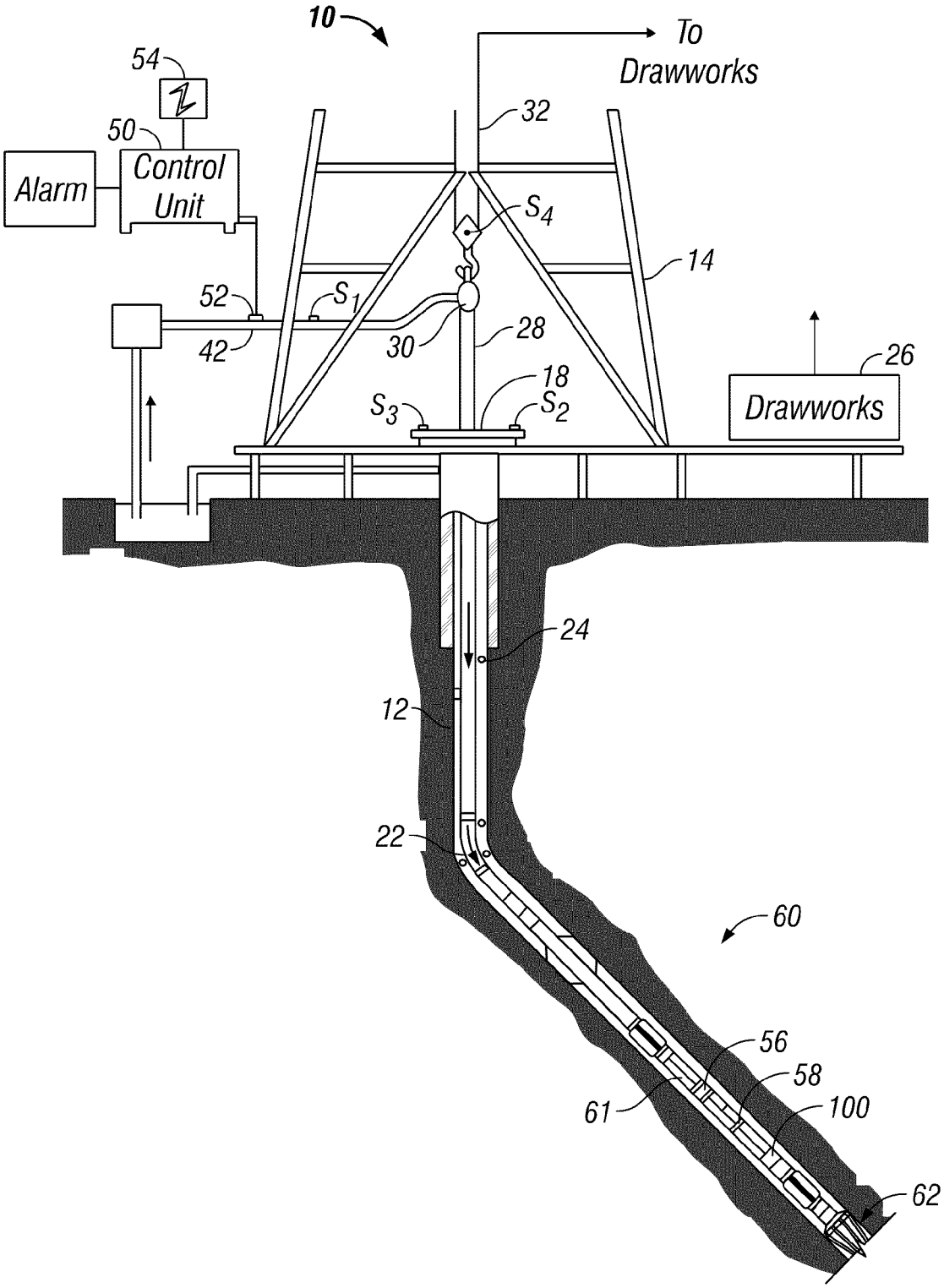
FIG. 1 illustrates a drilling system made in accordance with one embodiment of the present disclosure.

Referring now to FIG. 1, there is shown an embodiment of a drilling system 10 utilizing a bottomhole assembly (BHA) 60 configured for directionally drilling wellbores. As will be appreciated from the discussion below, the correction methodologies and systems according to the present disclosure may provide greater accuracy in placing a wellbore in the formation. In aspects, the correction for misalignment, sagging or bending in a drill string may be applied in real time to the directional survey taken in the wellbore. Therefore, the steerable drilling assemblies may be guided with better accuracy and may require fewer course corrections. Additionally, the increased precision in the directional surveys may enhance the quality of directionally-sensitive MWD measurements made during drilling. Additionally, the use of force measurement sensors as described herein may enhance tool service life and efficiency by providing an indication of "out of norm" or otherwise undesirable operating conditions.

In one embodiment, the system 10 shown in FIG. 1 includes a bottomhole assembly (BHA) 60 conveyed in a borehole 12 as part of a drill string 22. The drill string 22 includes a tubular string 24, which may be jointed drill pipe or coiled tubing, extending downward into the borehole 12 from a rig 14. The drill bit 62, attached to the drill string end, disintegrates the geological formations when it is rotated to drill the borehole 12. The drill string 22, which may be jointed tubulars or coiled tubing, may include power and/or data conductors such as wires for providing bi-directional communication and power transmission. The present disclosure is not limited to any particular rig or drilling assembly configuration. In some rig arrangements, the drill string 22 is coupled to a drawworks 26 via a kelly joint 28, swivel 30 and line 32 through a pulley (not shown). More commonly, a rig may use a rotary top drive system. Also the drilling system may be a simple rotary system, or a rotary steerable system.

In arrangements, a surface controller 50 receives signals from the downhole sensors and devices via a sensor 52 placed in the fluid line 42 and signals from sensors $S_1$, $S_2$, $S_3$, hook load sensor $S_4$ and any other sensors used in the system and processes such signals according to programmed instructions provided to the surface controller 50. The surface controller 50 displays desired drilling parameters and other information on a display/monitor 54 and is utilized by an operator to control the drilling operations. A communication system for transmitting uplinks and downlinks may include a mud-driven power generation units (mud pursers), or other suitable two-way communication systems that use hard wires (e.g., electrical conductors, fiber optics), acoustic signals, EM or RF.

The BHA 60 may include a formation evaluation sub 61 that may includes sensors for determining parameters of interest relating to the formation, borehole, geophysical characteristics, borehole fluids and boundary conditions. These sensor include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid. The BHA 60 may also include a processor 100, sensors 56 configured to measure various parameters of interest, and one or more survey instruments 58, all of which are described in greater detail below.

Figure 2:
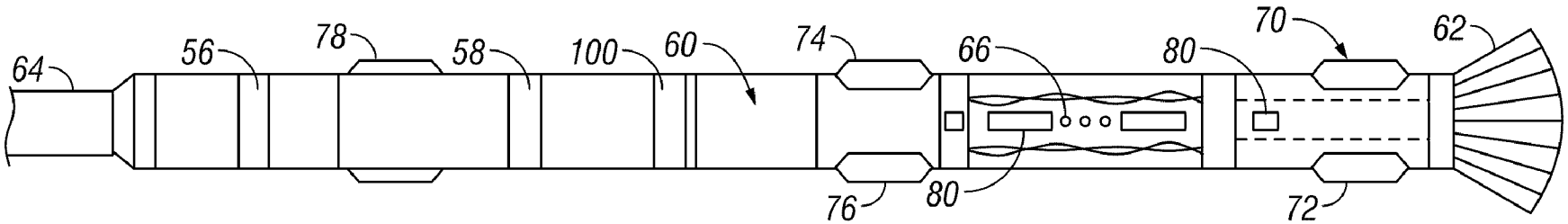
FIG. 2 illustrates in schematic format a BHA having a processor programmed to determine sag or bending correction in accordance with one embodiment of the present disclosure.

Referring now to FIG. 2, there is shown in greater detail certain elements of the BHA 60. The BHA 60 carries the drill bit 62 at its bottom or the downhole end for drilling the wellbore and is attached to a drill pipe 64 at its uphole or top end. A mud motor or drilling motor 66 above or uphole of the drill bit 62 may be a positive displacement motor, which is well known in the art. A turbine may also be used. Fluid supplied under pressure via the drill pipe 64 energizes the motor 66, which rotates the drill bit 62.

The BHA 60 also includes a first steering device 70 that contains one or more expandable ribs 72 that are independently controlled to exert a desired force on the wellbore wall to steer the drill bit 62 during drilling of the borehole. Each rib 72 can be adjusted to any position between a collapsed position and a fully extended position to apply the desired force vector to the wellbore wall. A second steering device 74 may disposed a suitable distance uphole of the first steering device 70. The steering device 74 also includes a plurality of independently controlled ribs 76. The force applied by the ribs 76 may be different from that applied by the ribs 72. One or more fixed stabilizers 78 may be disposed uphole of the second steering device 74. In the BHA configuration 60, the drill bit 62 may be rotated by the drilling motor 66 and/or by rotating the drill pipe 64. Thus, the drill pipe rotation may be superimposed on the drilling motor rotation for rotating the drill bit 62. The steering devices 70 and 74 may each have three ribs 72, 76 or pads for adequate control of the steering direction at each such device location. Fewer or greater number of ribs may be utilized in certain configurations. The ribs may be extended by any suitable method, such as a hydraulic system driven by the drilling motor that utilizes the drilling fluid or by a hydraulic system that utilizes sealed fluid in the BHA or by an electro-hydraulic system wherein a motor drives the hydraulic system or an electromechanical system wherein a motor drives the ribs. Any suitable mechanism for operating the ribs may be utilized for the purpose of this invention. One or more sensors 80 may be provided to measure the displacement of and/or the force applied by each rib 72, 76.

In embodiments, sensors may also be utilized to determine forces associated with fixed blade devices that are configured to engage a wellbore wall. Exemplary devices include centralizers or stabilizers that have one or more fixed ribs or blades mounted on the drill string or a non-rotating sleeve associated with the drill string. These types of devices may apply a normal force that may bend or deflect the drill string.

Figure 3:
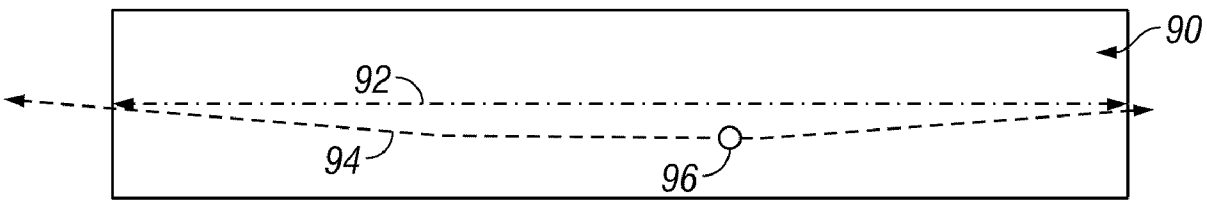
FIG. 3 illustrates the effect of sag or bending on a position of a survey tool.

Referring now to FIG. 3, there is shown in simplified form a portion of a borehole 90 having a borehole centerline 92, a curve indicating a tool centerline 94 for a sagging section of a BHA 60 (FIG. 2) and a directional sensor 96. As can be seen, the sag causes a misalignment between the tool centerline 94 on which the directional sensor 96 is positioned and the centerline 92 of the borehole. This misalignment translates into errors in the azimuth measurements and inclination measurements taken by the directional sensor 96. That is, a directional sensor 96 positioned at the borehole centerline 92 may measure a different azimuth or inclination than a directional sensor 96 positioned at the same axial location and along the tool centerline 94. One factor that causes the sag or bend in the BHA 60 may be gravity, which may be significant because the BHA 60 may be tens of meters in length. Moreover, other factors such as the forces exerted on the BHA 60 may also cause sag or bending the drill string 22. For this discussion, it should be understood that the BHA 60 is a part of the drill string 22. Thus, a reference to a bend in the drill string 22 may encompass a bend in the BHA 60.

Referring now to FIGS. 2 and 3, in particular, the steering devices 70, 74 may also impose forces on the BHA 60 that may contribute to sag or other misalignment between the borehole centerline 92 and the tool centerline 94. As discussed previously, the ribs 72, 76 apply force to the borehole wall to steer the drill bit 62 in a selected direction. These forces may also cause bending along the BHA 60. Still other factors may include drilling dynamics (e.g. weight on bit (WOB)) and environmental factors such as temperature and pressure.

Figure 4:
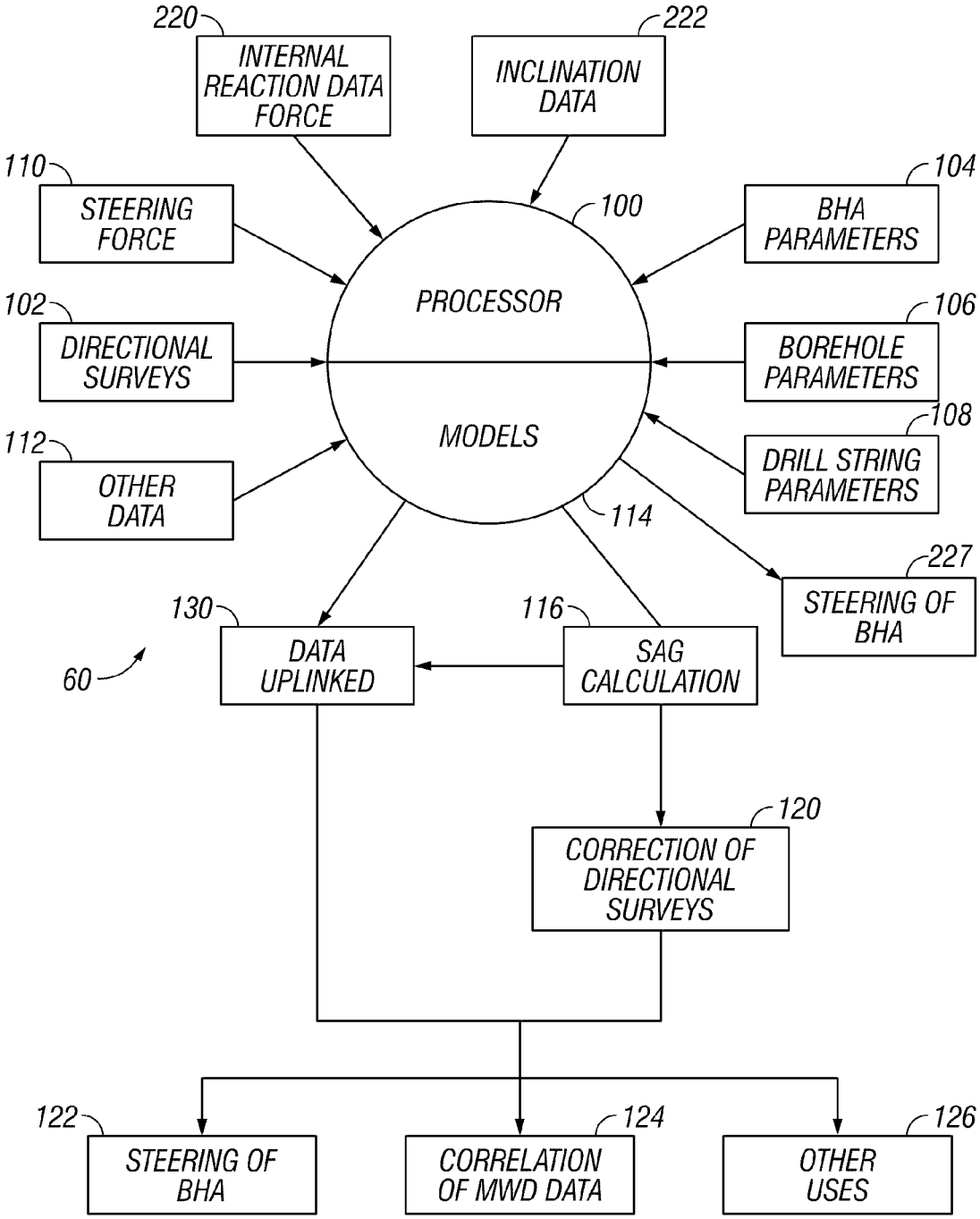
FIG. 4 illustrates in functional format exemplary methods for employing sag or bending correction using real time measurements.

Referring now to FIGS. 2 and 4, in aspects of the present disclosure, the BHA 60 may include a processor 100 programmed to correct directional survey measurements for sag causes by any of these or other factors. The processor 100 may be configured to decimate data, digitize data, and include suitable PLC's. For example, the processor may include one or more microprocessors that uses a computer program implemented on a suitable machine-readable medium that enables the processor to perform the control and processing. The machine-readable medium may include ROMs, EPROMs, EAROMs, Flash Memories and Optical disks.

In one arrangement, the processor 100 computes a sag or bending correction using a pre-programmed mathematical model of the BHA 60 and one or more real time or near-real time sensor measurements. The model may predict the response of the BHA 60 to one or more applied forces. These forces may be machine-induced forces and/or natural forces. The response may be characterized as a deflection, bending, twisting or other physical change to the shape or orientation of the BHA 60. Based on the pre-programmed model and the sensor measurements, the processor 100 calculates a correction that may be applied to the azimuth and inclination measurements provided by the directional survey tools. The correction in one sense converts the measured directional survey values to the directional values that would have been obtained if the directional survey instruments 58 had been aligned with the borehole centerline 92 (FIG. 3). The sensors and devices that may provide data to the processor 100 for sag or bending correction calculations are discussed below.

In embodiments, the processor 100 receives data from a sensor sub 56 that may include sensors, circuitry and processing software and algorithms for providing information that may cause deflection or misalignment in the BHA 60. Such information may include measurement of drilling parameters relating to the BHA, drill string, the drill bit and downhole equipment such as a drilling motor, steering unit, thrusters, etc. While the type and number of sensors may depend upon the specific drilling requirements, exemplary sensors may include drill bit sensors, an RPM sensor, a weight on bit sensor, sensors for measuring BHA operating parameters (e.g., mud motor stator temperature, differential pressure across a mud motor, and fluid flow rate through a mud motor), and sensors for measuring BHA or drill string dynamics parameters such as acceleration, vibration, whirl, radial displacement, stick-slip, torque, shock, vibration, strain, stress, bending moment, bit bounce, axial thrust, friction, backward rotation, BHA buckling and radial thrust. Other exemplary sensors include, but are not limited to, sensors distributed along the drill string that can measure drill string parameters or physical quantities such as drill string acceleration and strain, internal pressures in the drill string bore, vibration, electrical and magnetic field intensities inside the drill string, bore of the drill string, etc. Sensors for measuring internal reaction forces caused by the operation of the steering device 70 is described in greater detail later with reference to FIGS. 5-6. Still other devices such as calipers may be used to determine borehole parameters such as wellbore diameter. Suitable systems for making dynamic downhole measurements include COPILOT, a downhole measurement system, manufactured by BAKER HUGHES INCORPORATED. For simplicity, these sensors, tools, and instruments have been collectively referred to with numeral 56. Wellbore environmental parameters such as external pressure in the annulus and temperature may also be measured with suitable sensors.

The processor 100 may receive directional survey measurements from survey instruments such as three (3) axis accelerometers, magnetometers, gyroscopic devices and signal processing circuitry as generally known in the art. For simplicity, these sensors and instruments have been collectively referred to with numeral 58.

In FIG. 4, there is shown the overall functional relationship of the various aspects of the drilling system 60 described above. To effect drilling of a borehole, the BHA 60 is conveyed into borehole. The processor 100 has been programmed with one or more models 114 that predict the response of the BHA 60 to one or more forces that may be encountered while drilling the wellbore 12 and that may cause sag or other form of deflection of the tool line 94 (FIG. 3) associated with the BHA 60. The operator may set the initial drilling parameters to start the drilling along a preplanned trajectory. Either continuously or at periodic intervals while downhole, the system 60 takes directional surveys that may include azimuth and inclination 102, which may be transmitted to the processor 100. Using the sensors previously described, the processor 100 may receive measurements relating to BHA operating parameters 104, borehole parameters 106 (e.g., measured wellbore diameter), force parameters relating to the drill string 108 (e.g., bending moments in the BHA 60), force parameters associated with the steering device 110 (e.g., from sensors 80 of FIG. 2) and any other parameters 112 that may cause misalignment, sag, bending or deflection in a section of the BHA 60 that includes the directional survey instruments. These other parameters 112 may include environmental parameters such as external pressure or temperature. Some or all of these measurements may be taken in real-time while downhole. Thus, for instance, for each survey station along a drilled wellbore, the processor 100 may (i) obtain one or more directional survey measurements, (ii) and values for one or more parameters that could create errors in those directional survey measurements. In a sense, therefore, the correction to the survey measurements may be considered in real-time because such activities are occurring while drilling is on-going.

In one illustrative method, the processor 100 utilizes the measured parameters and processes such values using the models 114 to determine a correction 116 for the measured azimuth and inclination. The determined correction 116 may be utilized to correct azimuth and inclination downhole 120 and to determine other survey-related information such as vertical depth or true vertical depth. The sag corrected survey measurements may then be utilized for purposes such as steering 122 the BHA 60, the correlation of MWD measurements 124, and/or stored for later use 126. The processor 100 may also be programmed to dynamically adjust any model or database as a function of the drilling operations. It should be appreciated that with this method, the correction to survey measurements is performed while drilling. It should also be appreciated that, in embodiments, the corrected survey measurements may be utilized to estimate a position of a selected location either uphole or downhole of the survey instrument. For instance, directional coordinates (azimuth, inclination, TVD) may be estimated for a BHA tool such as a stabilizer or centralizer positioned downhole of the survey instrument.

In another illustrative method, the processor 100 may transmit data to the surface 130 for surface correction of directional survey measurements for sag or bending. The processor 100 may transmit "raw" or partially processed data to the surface. A surface processor may thereafter be used to correct the survey measurements. In another arrangement, the processor 100 may transmit uncorrected survey measurements and a calculated sag correction. In this arrangement, the processing activity is shared between the surface and the downhole processor. Thus, in embodiments, the processing of data to determine corrected survey measurements using real time data may be performed entirely downhole, entirely at the surface, or using a combination of downhole and surface computations.

Figure 5:
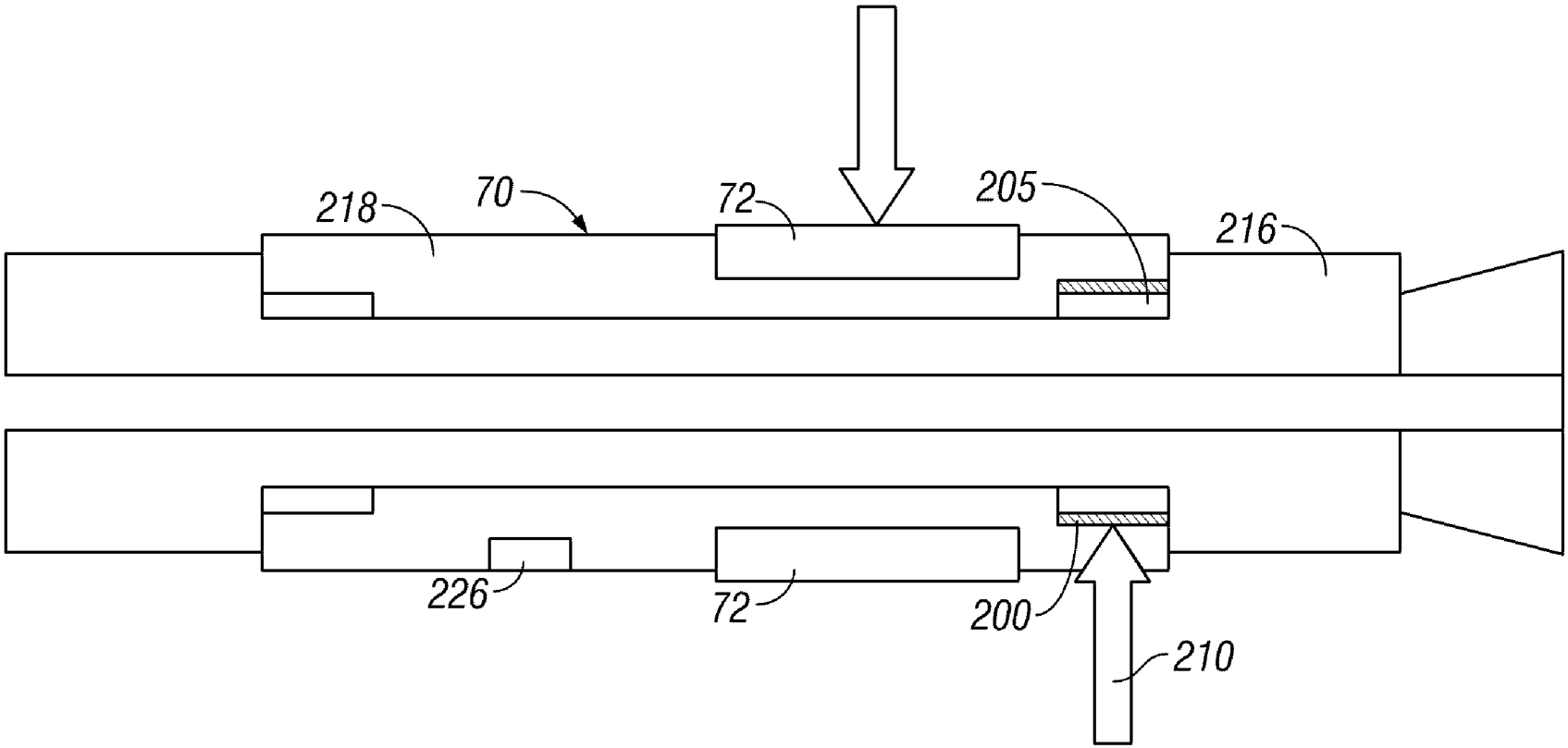
FIG. 5 schematically illustrates a steering device utilizing a force measurement sensor in accordance with one embodiment of the present disclosure.
Figure 6:
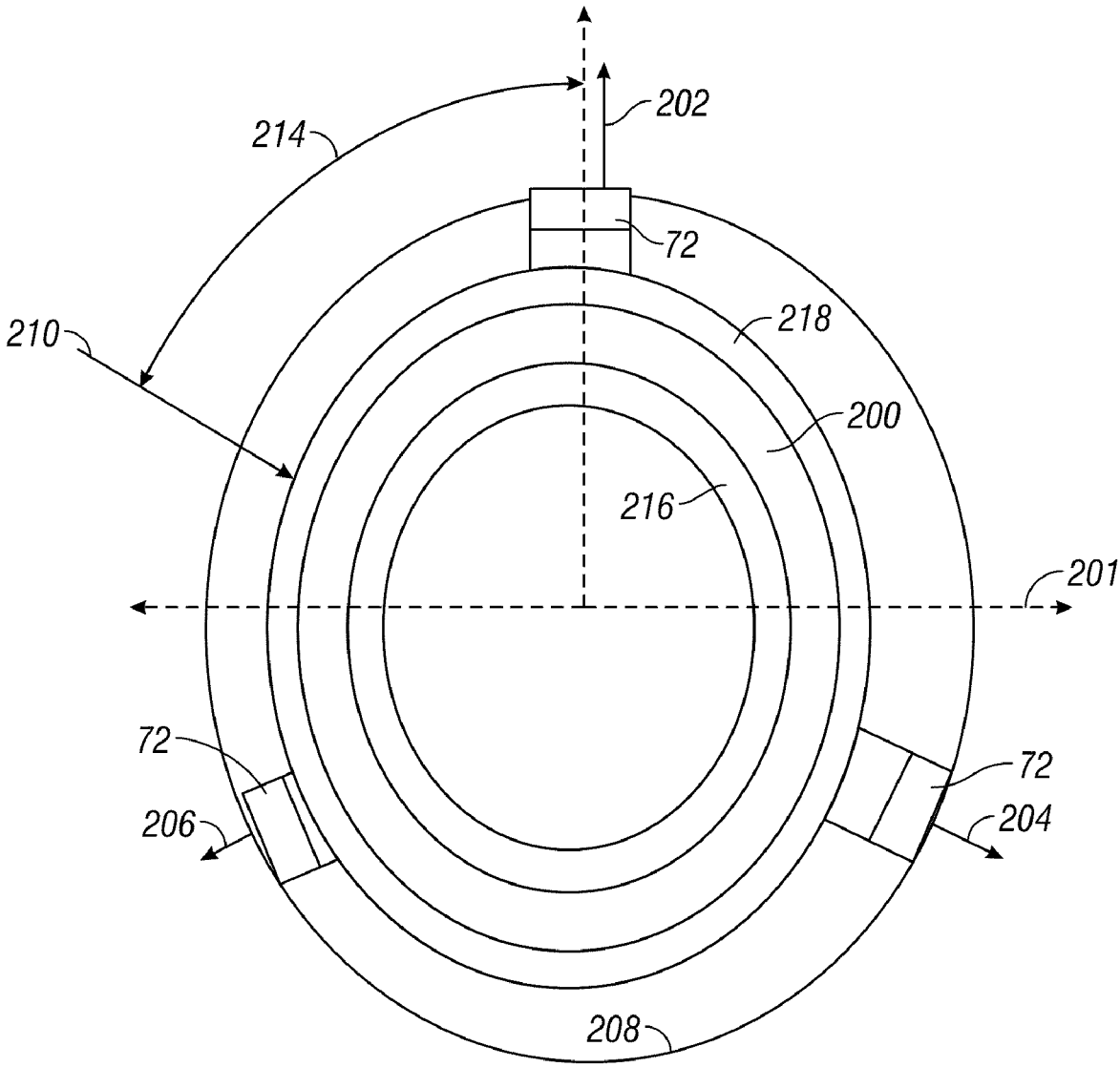
FIG. 6 sectionally illustrates the FIG. 5 embodiment and associated forces.

Referring now to FIG. 5, there is shown one embodiment of a sensor 200 that may be utilized to estimate a magnitude and/or direction of a force associated with the steering devices 70, 74 or other device that applies a force to the drill string 22. For ease of discussion, reference is made to only the steering device 70. In one arrangement, the sensor 200 may be utilized to estimate an internal reaction force 210 associated with the steering device 70. Referring now to FIG. 6, the ribs 72 of the steering device 70 are shown applying steering forces 202, 204, 206 on a wellbore wall 208. Opposing the steering forces 202, 204, 206, is the reaction force 210 that is applied via the steering device 70 to the drill string. The reaction force 210 may be characterized as having a magnitude and an azimuthal direction. The steering vector reaction force is transmitted from the steering device 70 to the drill bit 62 (FIG. 2) via the structural components of the drill string 22 generally shown in FIG. 2. An illustrative reaction force 210 corresponding to the steering forces 202, 204, 206 may be characterized as having a direction relative to a reference frame. In one convention, the angular position of a device relative to a reference frame, such as borehole highside, is defined as a "tool face" of the device. Thus, the circumferential position at which the reaction force 210 is applied to the steering device 70 may be correlated with a selected formation reference point such as borehole "highside," e.g., an internal reaction force may be reported as an angle 214 (e.g., 90 degrees) from wellbore highside. Embodiments of the present disclosure may utilize a force measurement sensor at any suitable location along the structural connection between the pads 72 of the steering device 70 and the drill bit 62.

Referring now to FIG. 5, in one embodiment, a sensor 200 may be positioned at or near an interface between a rotating member and non-rotating section of the steering device 70. In one arrangement, the sensor may be integrated into a bearing 205 between a rotating drive shaft 216 and a non-rotating sleeve 218. The sensor 200 may be fixed to and have a predetermined or fixed angular orientation relative to the non-rotating sleeve 218. Thus, when the directional sensors determine a tool face of the non-rotating sleeve 218 or the tool face of one or more of the pads 72, 74, 76 of the steering device 70, the tool face angle of the sensor may also be determined or estimated due to the fixed angular relationship between the non-rotating sleeve 218 and the sensor 200. Exemplary sensors 200 for measuring force include strain gages, thin "sim" metal strain gages, fiber optical gages, load cells, etc.

As shown in FIG. 5, the non-rotating sleeve 218 does not rotate relative to the wellbore wall. While some slight rotation may occur, the non-rotating sleeve 218 may be considered rotationally stationary relative to the formation. In other applications, the sensor may be positioned at an interface between two members that each rotate relative to the formation and rotate relative to one another (e.g., in top drive rotary steerable systems, the drilling motor and its internal components such as bearings may rotate with the drill string). Generally speaking, therefore, the sensor may be positioned at any location, system or component in the drill string wherein the reaction force is measurable.

In other embodiments, the force measurement sensor 200 may be separate from the bearing 205. For example, the sensor 200 may be formed as a tubular member or sleeve that may be interposed between the bearing 205 and the non-rotating section of the steering device 70.

Referring now to FIGS. 5-6, in one illustrative method, the steering device 70 via the ribs 72 apply a predetermined steering force to the wellbore wall 208 to steer the bottomhole assembly 60 in a desired direction. During this steering, a processor utilizes the measurements provided by the sensor 200 to estimate one or more characteristics of the reaction force 210 being applied to the steering device 70. One characteristic may be the magnitude of the reaction force 210. Another characteristic may be the azimuthal direction. In estimating the azimuthal direction, the processor may first determine a circumferential position of the reaction force 210 on the sensor 200 and then estimate the angular offset of that determined circumferential position relative to the tool face; i.e., the processor may estimate the tool face angle 214 of the reaction force 210.

In one arrangement, the processor may be a surface processor 50 (FIG. 1) that receives data from the sensor 200 in the wellbore. The data may be raw data. Also, the data may be partially processed or fully processed in order to reduce bandwidth requirements. Personnel at the surface may utilize the sensor 200 data to evaluate the operating conditions for the steering device 70. For example, personnel may adjust the operation of the steering device 70 to maintain the reaction force 210 within a prescribed range or norm.

Referring now to FIGS. 2, 4-6, in another arrangement, the processor may be a downhole processor 100 that may be programmed with models and algorithms 114 for operating the steering device 70 to maintain the reaction force 210 with a prescribed range or norm. The prescribed range or norm may be based on considerations such as accuracy of directional drilling or enhancing tool service life or efficiency. In embodiments, the downhole processor 100 may control the steering device 70 using, in part, the data provided by the sensor 200.

Referring in particular to FIG. 4, to enhance steering accuracy, the processor 100 may include a predictive model 114 that estimates the magnitude and/or azimuthal direction of a reaction force generated by the side forces applied by the steering device 70. Alternatively or additionally, the expected vector of the reaction force may be preprogrammed. During drilling, the actual magnitude and/or direction of the reaction force may be estimated, shown by box 220, and compared with the expected or desired reaction force. If the direction and/or magnitude varies more than a predetermined amount, then the processor 100 may adjust the force applied by the ribs 72 in a manner that substantially aligns the measured reaction force with the desired reaction force, such steering action shown by box 227. It will be appreciated that this form of feed-back control allows the steering force applied by the steering device 70 to be adjusted to account for the lithological characteristics (e.g., hard formations) of the surrounding formation.

To enhance tool life and/or efficiency, the processor 100 may receive force data, box 220, from the force measurement sensor 200 and/or inclination data, box 222, from an inclination sensor 226 (FIG. 5). Illustrative inclination sensors include single axis and multi-axis accelerometers. The processor 100 may utilize the inclination data 222 to estimate the stresses imposed on the steering device 70 as well as other components of the BHA 60 that are along the axis extending between the wellbore highside and low side, or vertical axis. That is, if the measured inclination exceeds an expected or desired inclination, it may be considered an indication that the stresses imposed on the steering device 70 or other component of the BHA 60 has exceeded a preset threshold. Therefore, the processor 100 may adjust the steering device 70 to reduce the steering force applied by the steering device 70. Also, the processor 100 may utilize the force data 222 from the sensor 200 (FIG. 5) to estimate the internal forces applied to the steering device 70 as well as other components of the BHA 60. In particular, the force data 222 may provide an indication of the internal forces along a horizontal axis orthogonal to the vertical axis, this orthogonal axis being labeled with numeral 201 in FIG. 6. If the measured reaction force exceeds an expected or desired reaction force, the processor 100 may adjust the steering device 70 to reduce the steering force applied by the steering device 70. These steering adjustments and controls are shown by box 227. It should be understood these particular applications of the use of the force data 220 are merely illustrative and numerous other uses may be available for the data furnished by the sensor 200. For example, the measurements of internal reaction force may be utilized in connection with the sag correction devices and methodologies discussed earlier. While box 227 is shown as utilizing data, such as directional data directly, in embodiments, such data may be corrected for sag via the steps 130 and/or 116 of FIG. 4 prior to adjusting the operation of the steering device 70.

From the above, it should be appreciated that what has been described includes, in part, systems and methods for determining a trajectory of a wellbore drilled in an earthen formation. The method may be used in connection with a drill string having one or more sensors configured to measure parameters relating to the downhole environment, the wellbore being drilled, the drill string being used to drill the wellbore, and/or forces that are applied to the drill string. In one embodiment, the method may include determining one or more survey parameters at a location in the wellbore using suitable survey instruments; measuring one or more force parameters in the wellbore using one or more sensors provided on the drill string; and correcting the survey parameter using the measured force parameter. The downhole measured force parameter may be a force associated with an operation of a steering device, and/or a bending moment. The downhole measured parameter may also be a normal force associated with a wellbore engagement device such as a centralizer or stabilizer that engages a wellbore wall. Moreover, the method may include measuring a wellbore diameter and correcting the survey parameter using the measured wellbore diameter. The method may be utilized in real-time or near real-time. For instance, in certain applications, the force parameter may be measured at approximately the same time that the survey parameter is determined. Additionally, the method may be performed in situ in the wellbore. Thus, in certain embodiments, the method may include conveying into the wellbore a processor that is programmed to perform the correction while in the wellbore. Further, in certain applications, the method may include estimating at least one directional coordinate for a selected wellbore device along the drill string using the corrected at least one survey parameter.

What has been described further includes, in part, an illustrative application wherein a drill string may be conveyed into the wellbore and the method may be used to determine a bend attributable to force parameters measured in the wellbore. In another illustrative application, the method may be used to steer a drill string by using survey parameters that have been corrected.

What has been described also includes, in part, a method for providing continuous corrected survey data during drilling. The method may include determining survey parameters at several locations in the wellbore; measuring a force parameter in the wellbore at these locations; and correcting the survey parameter determined at each of the locations using the force parameter measured at each of the locations.

What has been described also includes, in part, a method for determining a trajectory of a wellbore drilled in an earthen formation that includes determining a survey parameter at a location in the wellbore; measuring a temperature in the wellbore; measuring a parameter in the wellbore in addition to the temperature; and correcting the survey parameter using the measured parameter and the measured temperature.

Still further, what has been described also includes, in part, a computer-readable medium for use with an apparatus for correcting survey data relating to a drilled wellbore. The apparatus may include a drill string conveyed into a wellbore in the earth formation, a steering device that steers the drill string, a survey tool for measuring a survey parameter, and a sensor for measuring a force parameter. The medium may include instructions that enable the processor to correct the measured survey parameter using the measured force parameter. In arrangements, the medium may also include (i) a ROM, (ii) an EPROM, (iii) an EEPROM, (iv) a flash memory, and (v) an optical disk. What has been described also includes, in part, an apparatus for steering a drill string. The apparatus may include a steering device having pads that apply a force to a wall of a wellbore and a force measurement sensor configured to measure a reaction The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

We claim:

1. A method for determining a trajectory of a wellbore drilled in an earthen formation, comprising:

(a) determining at least one survey parameter for a drill string at a location in the wellbore;

(b) measuring at least one force parameter at the drill string in the wellbore; and (c) correcting the at least one survey parameter for physical distortion of the drill string using the at least one measured force parameter to determine the trajectory of the wellbore.

2. The method according to claim 1, wherein the measured at least one force parameter is a force associated with an operation of a steering device.

3. The method according to claim 1, further comprising measuring a wellbore diameter and correcting the at least one survey parameter using the measured wellbore diameter.

4. The method according to claim 1, wherein the at least one force parameter is measured at substantially the same time the at least one survey parameter is determined.

5. The method according to claim 1, further comprising conveying a processor into the wellbore, wherein the correcting is performed by the processor while in the wellbore.

6. The method according to claim 1, further comprising conveying the drill string into the wellbore; and determining a bend attributable to the measured at least one force parameter.

7. The method according to claim 1, further comprising conveying a drill string into the wellbore; and steering the drill string using the corrected at least one survey parameter.

8. The method according to claim 1, wherein the at least one survey parameter includes azimuth and inclination.

9. The method according to claim 8, further comprising:

determining at least one survey parameter at a plurality of locations in the wellbore;

measuring at least one force parameter in the wellbore at the plurality of locations; and correcting the at least one survey parameter determined at each of the locations using the at least one force parameter measured at each of the locations.

10. The method according to claim 1, wherein the downhole measured parameter is a normal force associated with a wellbore engagement device engaging a wellbore wall.

11. The method according to claim 1, further comprising estimating at least one directional coordinate for a selected wellbore device along the drill string using the corrected at least one survey parameter.

12. The method according to claim 1, wherein the at least one measured force parameter is an internal reaction force caused by operation of a steering device.

13. A method for determining a trajectory of a wellbore drilled in an earthen formation, comprising:

(a) determining at least one survey parameter for a drill string at a location in the wellbore;

(b) measuring a temperature in the wellbore;

(c) measuring at least one force parameter at the drill string in the wellbore in addition to the temperature; and (d) correcting the at least one survey parameter for physical distortion of the drill string using the at least one measured force parameter and the measured temperature to determine the trajectory of the wellbore.

14. The method according to claim 13, wherein the at least one parameter in the wellbore is one of: (i) a force associated with an operation of a steering device, and (ii) bending moment.

15. The method according to claim 13, further comprising measuring a wellbore diameter and correcting the at least one survey parameter using the measured wellbore diameter.

16. The method according to claim 13, further comprising conveying a processor into the wellbore, wherein the correcting is performed by the processor while in the wellbore.

17. The method according to claim 13, further comprising conveying a drill string into the wellbore; and steering the drill string using the corrected at least one survey parameter.

18. The method according to claim 13, wherein the at least one measured force parameter is an internal reaction force caused by operation of a steering device.

19. A computer-readable medium for use with an apparatus for correcting survey data relating to a drilled wellbore, the apparatus comprising: a drill string configured to be conveyed into a wellbore in the earth formation; a steering device configured to steer the drill string; a survey tool for measuring at least one survey parameter, an a sensor for measuring at least one force parameter; the medium comprising:

instructions that enable at least one processor to correct the measured at least one survey parameter for a distortion of the drill string using the measured at least one force parameter.

20. The medium of claim 19 further comprising at least one of: (i) a ROM, (ii) an EPROM, (iii) an EEPROM, (iv) a flash memory, and (v) an optical disk.

21. An apparatus for steering a drill string, comprising:

a steering device having at least one pad on the drill string configured to apply a force to a wall of a wellbore;

a force measurement sensor configured to measure a reaction force associated with the force applied by the at least one pad;

a directional sensor configured to determine at least one survey parameter at a location in the wellbore; and a processor configured to correct the at least one survey parameter for a distortion of the drill string using the at least one measured reaction force to steer the drill string.

22. A method for controlling a steering device for steering a drill string, comprising:

operating the steering device to apply a force to a wall of the wellbore;

measuring a reaction force associated with the force applied by the steering device;

determining a survey parameter at a location in the wellbore;

correcting the survey parameter for a distortion of the drill string using the at least one measured reaction force; and using the corrected survey parameter to control the steering device.

* * * * *